US008834331B1

(12) United States Patent
Boatwright

(10) Patent No.: US 8,834,331 B1
(45) Date of Patent: Sep. 16, 2014

(54) PRONGED BAND CONNECTOR, AND METHOD FOR SECURING AN ELASTIC EXERCISE BAND

(71) Applicant: Donald Jeffrey Boatwright, Charlotte, NC (US)

(72) Inventor: Donald Jeffrey Boatwright, Charlotte, NC (US)

( * ) Notice: Subject to any disclaimer, the term of this patent is extended or adjusted under 35 U.S.C. 154(b) by 0 days.

(21) Appl. No.: 13/894,696

(22) Filed: May 15, 2013

Related U.S. Application Data

(63) Continuation of application No. 13/751,545, filed on Jan. 28, 2013.

(51) Int. Cl.
*A63B 21/04* (2006.01)
*A63B 21/02* (2006.01)
*B23P 19/04* (2006.01)

(52) U.S. Cl.
CPC ..... *B23P 19/048* (2013.01)
USPC ..... 482/129; 482/121; 482/122

(58) Field of Classification Search
USPC ..... 482/91, 121, 124, 129, 131, 218; 24/71.1, 68 E, 68 D, 197, 200
See application file for complete search history.

(56) References Cited

U.S. PATENT DOCUMENTS

| | | | | | |
|---|---|---|---|---|---|
| 143,668 | A | * | 10/1873 | Clark | 54/74 |
| 210,836 | A | * | 12/1878 | Blyth | 54/36 |
| 575,164 | A | * | 1/1897 | Perkins | 42/85 |
| 5,660,445 | A | * | 8/1997 | Murray | 297/485 |
| 5,816,984 | A | * | 10/1998 | Weiss | 482/121 |

* cited by examiner

*Primary Examiner* — Loan H Thanh
*Assistant Examiner* — Rae Fischer
(74) *Attorney, Agent, or Firm* — Schwartz Law Firm, P.C.

(57) ABSTRACT

A pronged band connector is adapted for securing a flat elastic exercise resistance band to an adjacent structure. The exercise band has a length, width, and thickness. The exemplary band connector comprises a base and a plurality of spaced-apart elongated rigid prongs. The prongs extend substantially perpendicular to the base, and are adapted for receiving a portion of the exercise band between adjacent prongs. A length of each prong may be greater than the width of the exercise band.

20 Claims, 16 Drawing Sheets

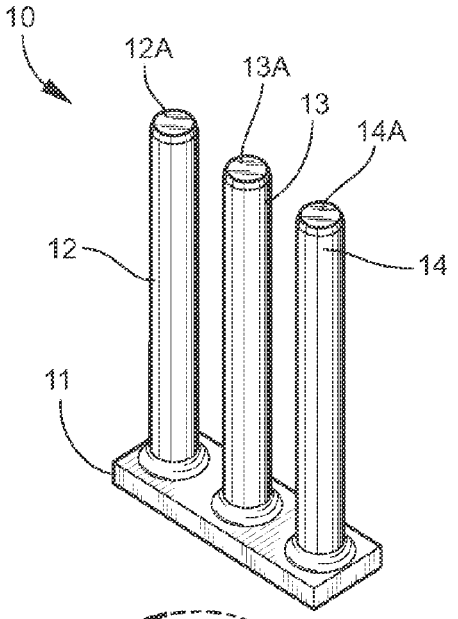
Fig. 1
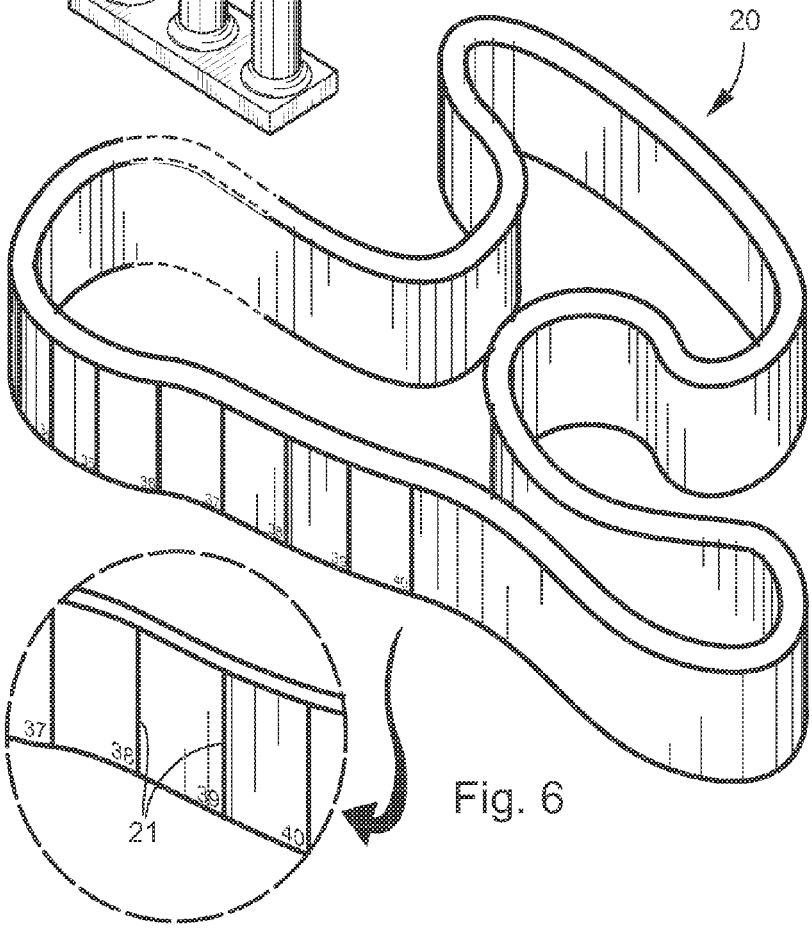
Fig. 6
Fig. 6A
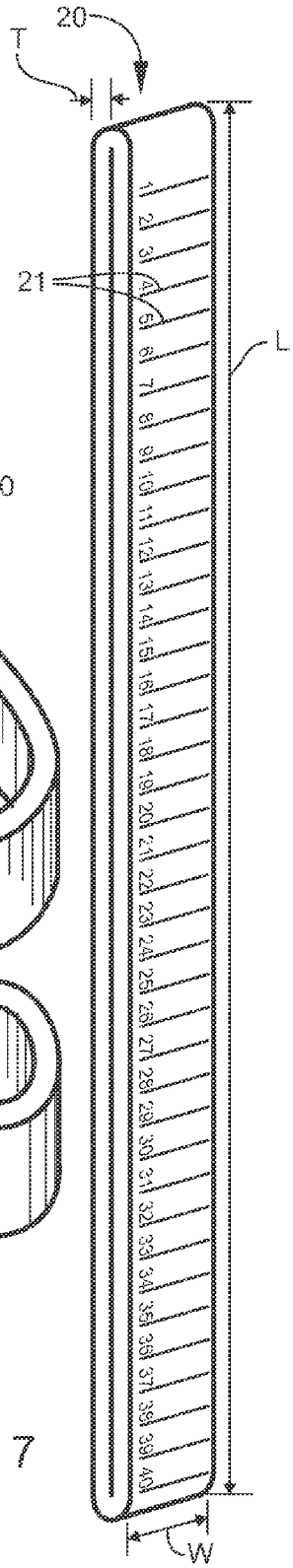
Fig. 7

PRONGED BAND CONNECTOR, AND METHOD FOR SECURING AN ELASTIC EXERCISE BAND

TECHNICAL FIELD AND BACKGROUND OF THE INVENTION

This invention relates generally to a pronged band connector, and method for securing an elastic exercise resistance band to an adjacent structure. The exemplary band connector is used in combination with an elastic exercise resistance band. In further exemplary embodiments, the disclosure comprises the combination of a stationary exercise stand, elastic resistance band, and pronged band connector.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a pronged band connector adapted for securing a flat elastic exercise resistance band to an adjacent structure. The exercise band has a length, width, and thickness. The exemplary band connector comprises a base and a plurality of spaced-apart elongated rigid prongs. The prongs extend substantially perpendicular to the base, and are adapted for receiving a portion of the exercise band between adjacent prongs. A length of each prong may be greater than the width of the exercise band.

The term "adjacent structure" refers broadly and generally herein to any fixed or movable part, element, device, or component. For example, an adjacent structure may comprise a stationary exercise stand, a fixed or movable exercise bar or handle, a second exercise resistance band, or the like.

According to another exemplary embodiment, the base and the prongs are integrally-formed together of a homogenous solid metal. The term "integrally-formed" refers herein to two or more elements or components which are joined together as a single inseparable unit. The term "homogenous" means having a uniform composition or structure.

According to another exemplary embodiment, the distance between adjacent prongs is between approximately 0.5 and 1.0 inches.

According to another exemplary embodiment, the length of each prong is between approximately 2 and 5 inches.

According to another exemplary embodiment, the width of the exercise band is between approximately 0.5 and 5 inches.

According to another exemplary embodiment, the thickness of the exercise band is between approximately 0.125 and 0.500 inches.

According to another exemplary embodiment, the exercise band has graduated markings.

According to another exemplary embodiment, the prongs are substantial identical in length and diameter.

According to another exemplary embodiment, the prongs have respective beveled tips.

In yet another exemplary embodiment, the pronged band connector consists of a base and exactly three spaced-apart elongated rigid prongs formed with the base and adapted for receiving a portion of the exercise band between adjacent prongs.

According to another exemplary embodiment, the exercise band comprises a homogenous flat rubber band having a length, width, and thickness.

In yet another exemplary embodiment, the present disclosure comprises a pronged band connector adapted for use in combination with an elastic exercise resistance band and a stationary exercise stand.

The present disclosure further comprises a method for securing an elastic exercise resistance band to an adjacent structure—the adjacent structure including (e.g.) a stationary exercise stand, an exercise handle, a second exercise band, or other movable, fixed, or substantially fixed element or structure. The exemplary method includes the step of inserting rigid prongs of a multi-pronged connector through folded portion(s) of the band.

BRIEF DESCRIPTION OF THE DRAWINGS

Exemplary embodiments of the present invention will hereinafter be described in conjunction with the following drawing figures, wherein like numerals denote like elements, and wherein:

FIG. 1 is a perspective view of the present resistance band connector according to one exemplary embodiment of the disclosure;

FIG. 6 is a perspective view of an elastic exercise resistance band according to one exemplary embodiment;

FIG. 6A is an enlarged fragmentary view of the exercise resistance band;

FIG. 7 is a view of the exercise resistance band in a folded condition showing the graduated markings along the folded length of the band;

DESCRIPTION OF EXEMPLARY EMBODIMENTS AND BEST MODE

Figure 2:
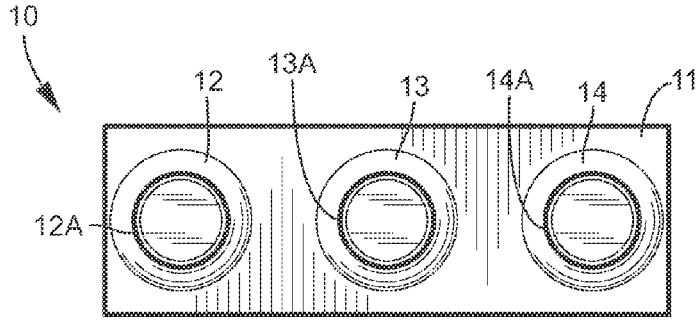
FIG. 2 is a top view of the exemplary band connector.
Figure 3:
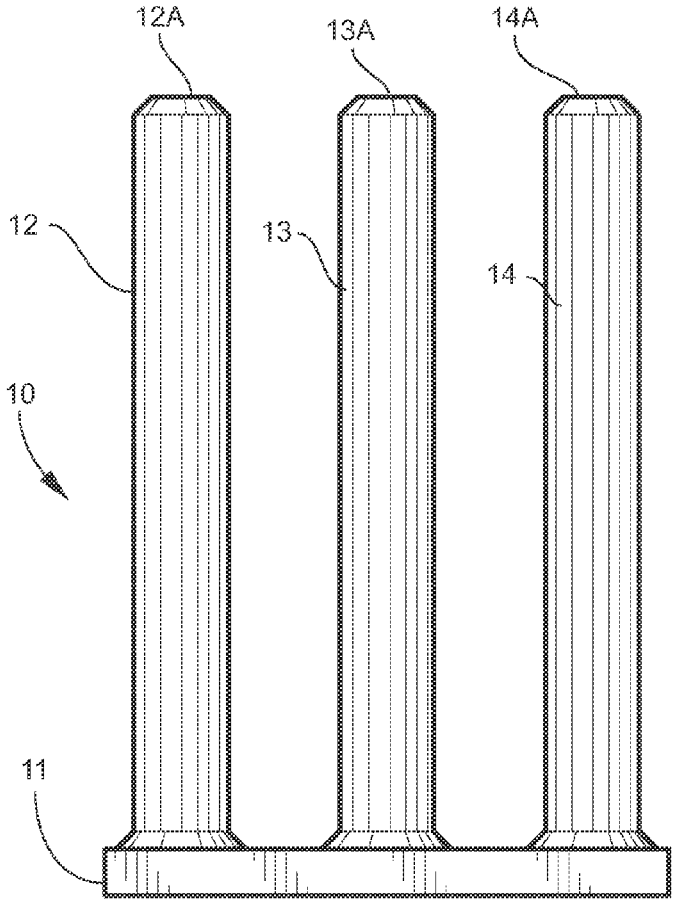
FIG. 3 is a side view of the exemplary band connector.
Figure 5:
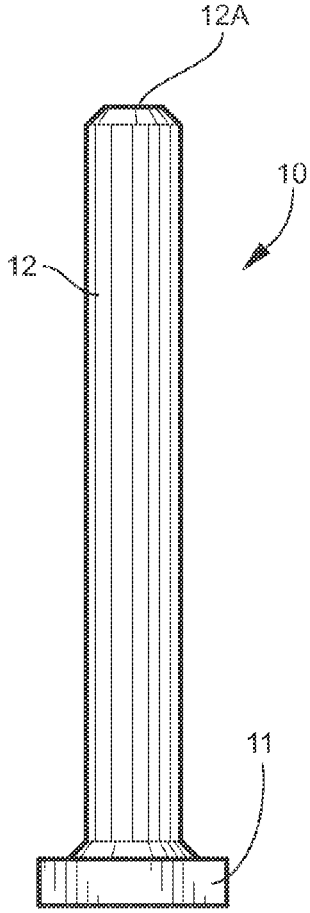
FIG. 5 is an end view of the exemplary band connector.
Figure 4:
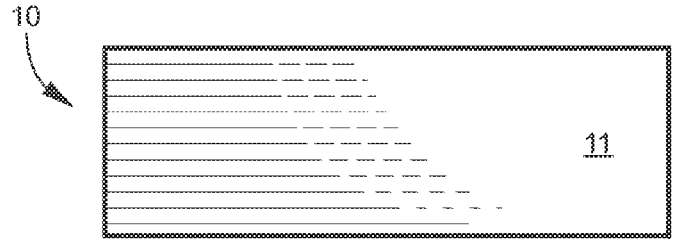
FIG. 4 is a rear view of the exemplary band connector.

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawings, a multi-pronged band connector according to one exemplary embodiment of the present disclosure is illustrated in FIGS. 1-5, and shown generally at reference numeral 10. The exemplary connector 10 is fabricated of metal, and comprises a generally rectangular base 11 and a plurality of spaced-apart elongated cylindrical prongs 12, 13, 14. The rigid metal prongs 12, 13, 14 extend substantially perpendicular to the metal base 11, and may be attached to the base 11 by welding, mating screw threads, hardware, or other suitable means. In the exemplary embodiment, the prongs 12, 13, 14 have respective beveled tips 12A, 13A, 14A, and are substantially identical in shape and dimension. The length of each prong 12, 13, 14 is between about 2 and 5 inches (e.g., 4 inches); and the diameter of each prong between about 0.375 and 0.625 inches (e.g., 0.5 inches); and the spacing between adjacent prongs between about 0.5 and 1.0 inches (e.g., 0.75 inches). The length of the exemplary base 11 is about 3.0 inches, the width about 1.0 inches, and the thickness about 0.25 inches.

Figure 8:
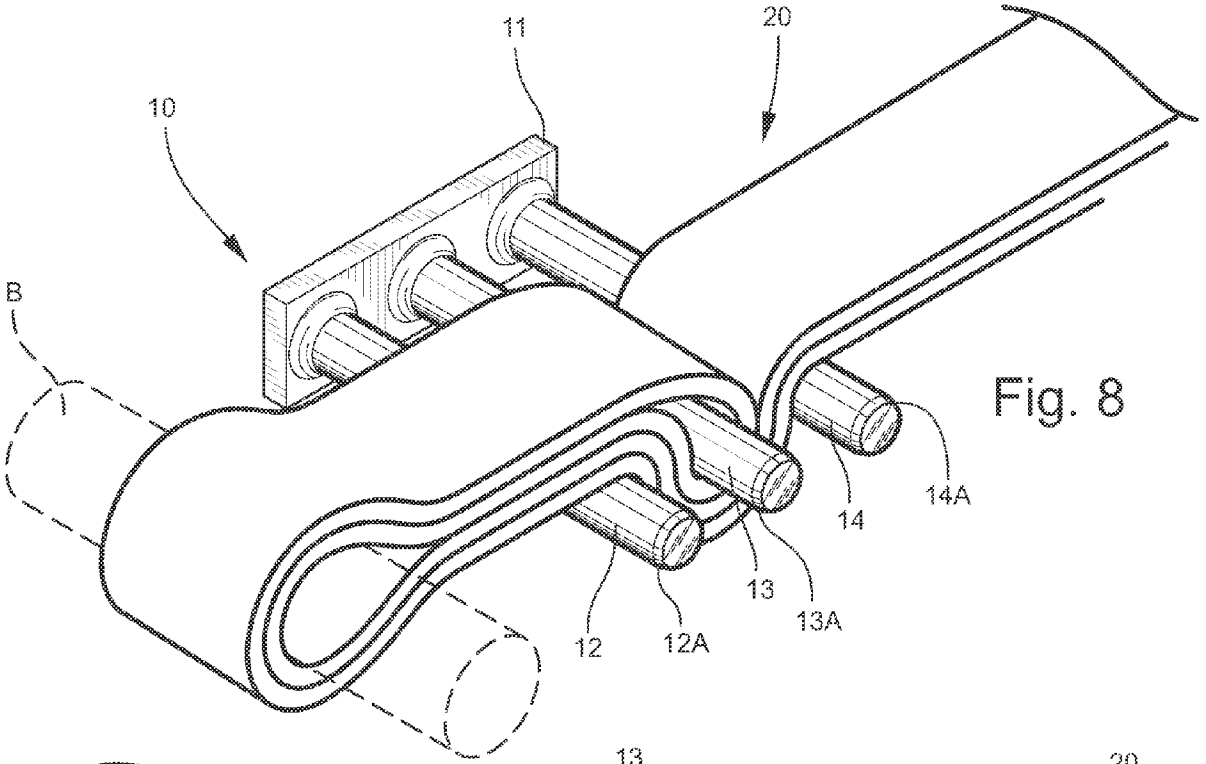
FIG. 8 is a perspective view illustrating application of the present band connector for securing the exercise resistance band to an adjacent bar—the bar being shown in phantom lines.
Figure 9:
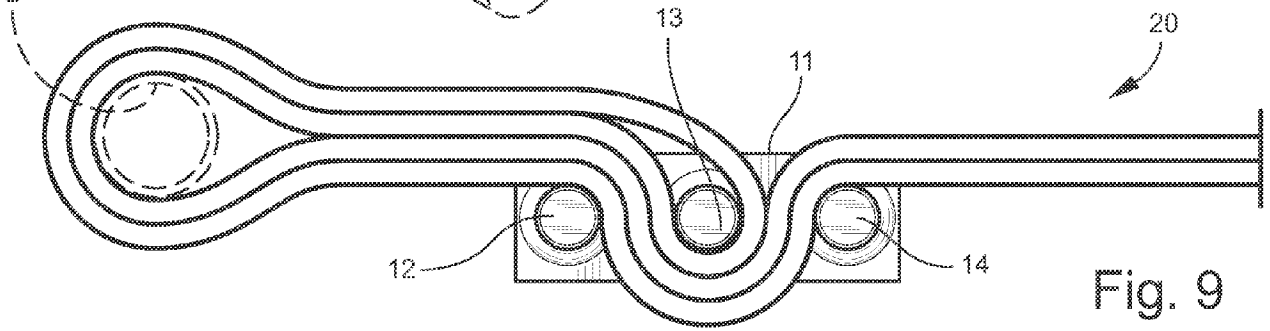
FIG. 9 is a further view of the band connector and resistance band illustrated in FIG. 8.

The present band connector 10 is used in combination with an elastic, flat, continuous-loop exercise resistance band 20, shown in FIGS. 6 and 7. The exemplary exercise band 20 is fabricated of a homogenous natural or synthetic rubber, and has folded length "L" (i.e., one-half its circumference), width "W", and thickness "T" dimensions. A folded length of the band 20 includes graduated markings 21 (e.g., 1-40 at 1.0 inch increments) which may be used to indicate proper placement of the pronged connector 10 for measurable, consistent and repeatable band resistance between exercises. FIGS. 8 and 9 show the pronged connector 10 used to secure one end of the exercise band 20 to an adjacent structure, such as bar "B" indicated in phantom lines. The rigid prongs 12, 13, 14 are sufficiently spaced-apart from one another to receive a folded portion of the exercised band 20 therebetween, and are sufficiently long to extend slightly beyond the inserted width of the band 20. In the exemplary embodiment, width "W" of the exercise band 20 is between about 0.5 and 5 inches, and the thickness "T" of the exercise band 20 between about 0.125 and 0.500 inches, and the folded length "L" of the exercise band between about 30-50 inches. As best shown in FIG. 9, the spacing between adjacent prongs 12, 13, 14 may be sufficient to receive at least 3 times the thickness "T" of the exercise band 20.

Figure 10:
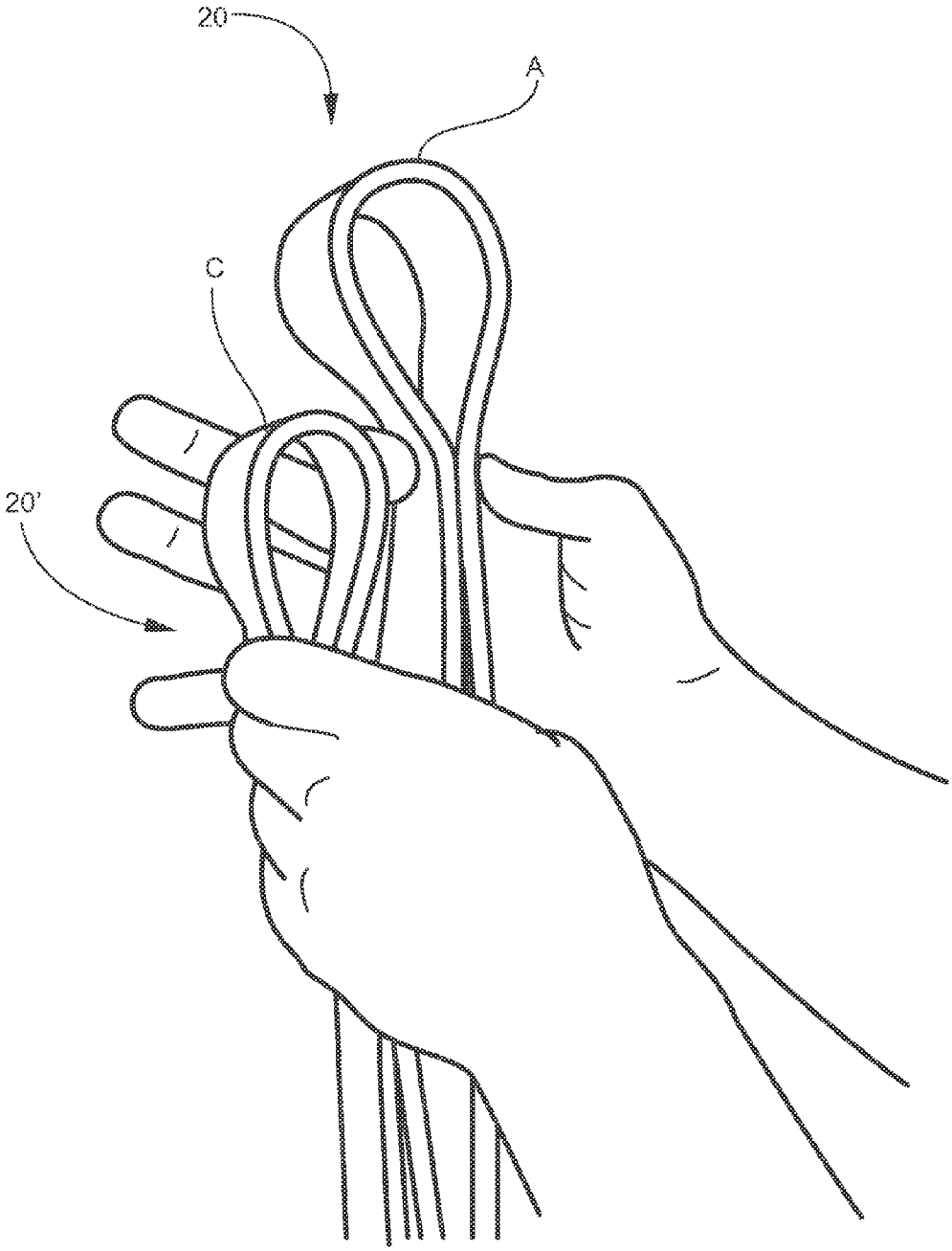
FIGS. 10-15 are sequential views demonstrating application of the exemplary band connector for interconnecting respective ends of two exercise resistance bands.
Figure 11:
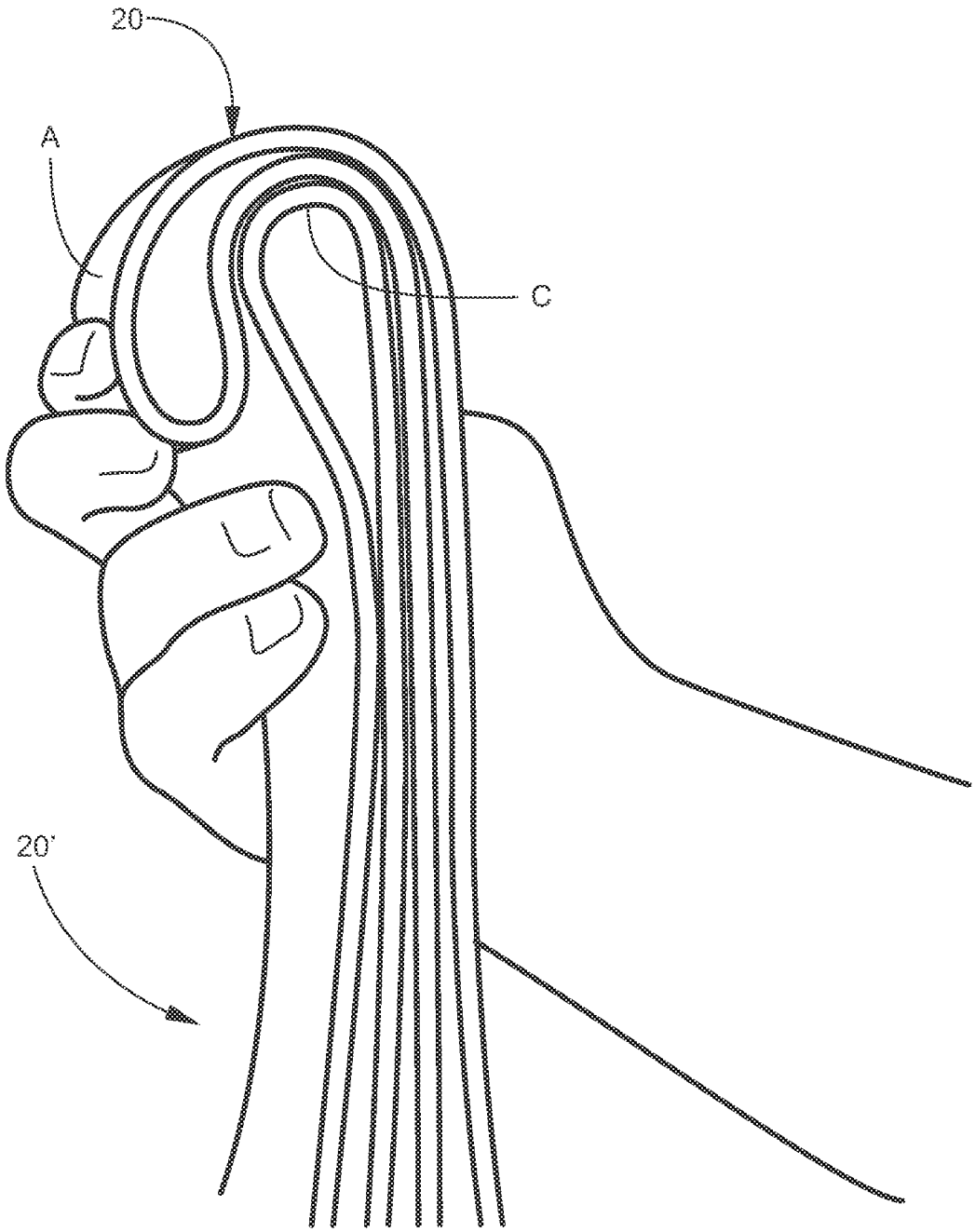
Figure 12:
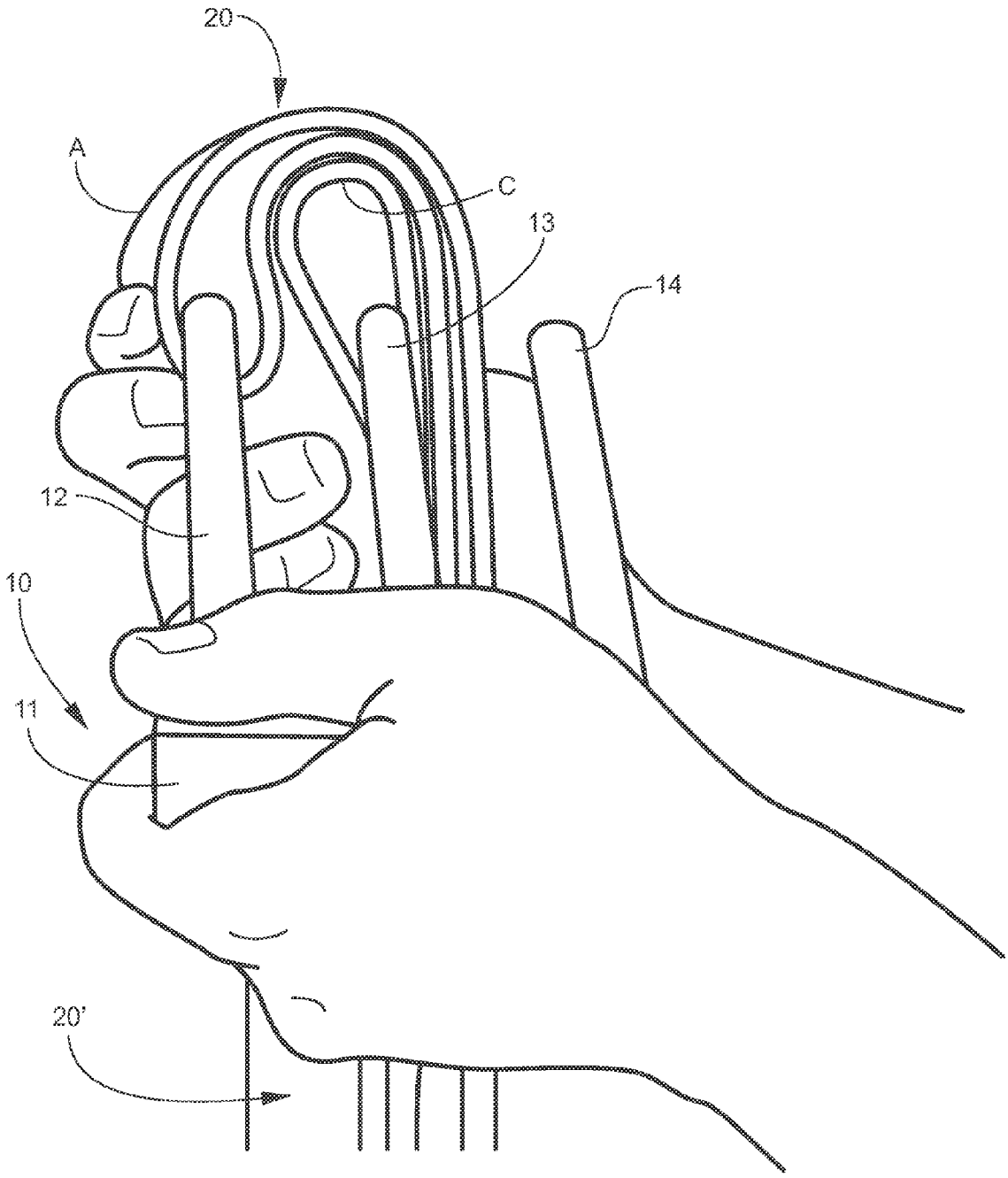
Figure 13:
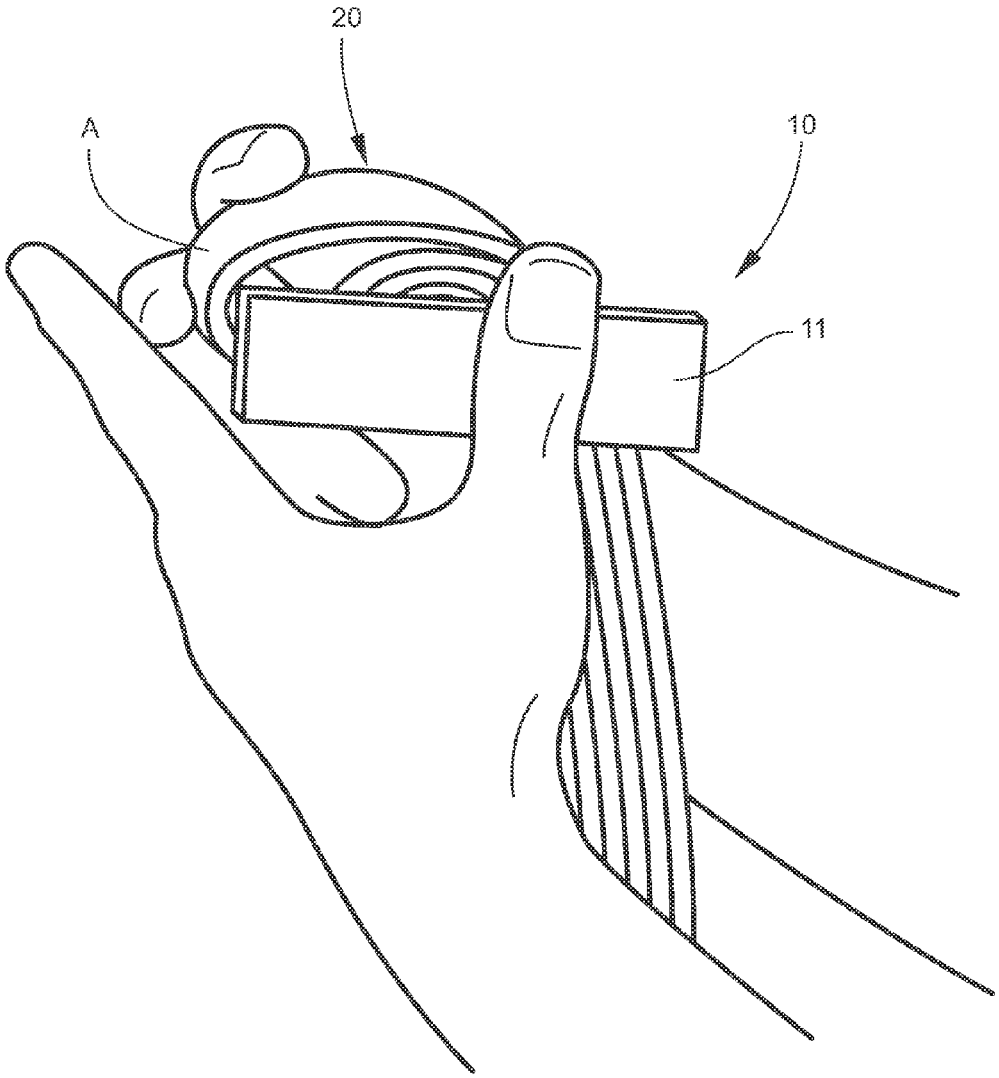
Figure 14:
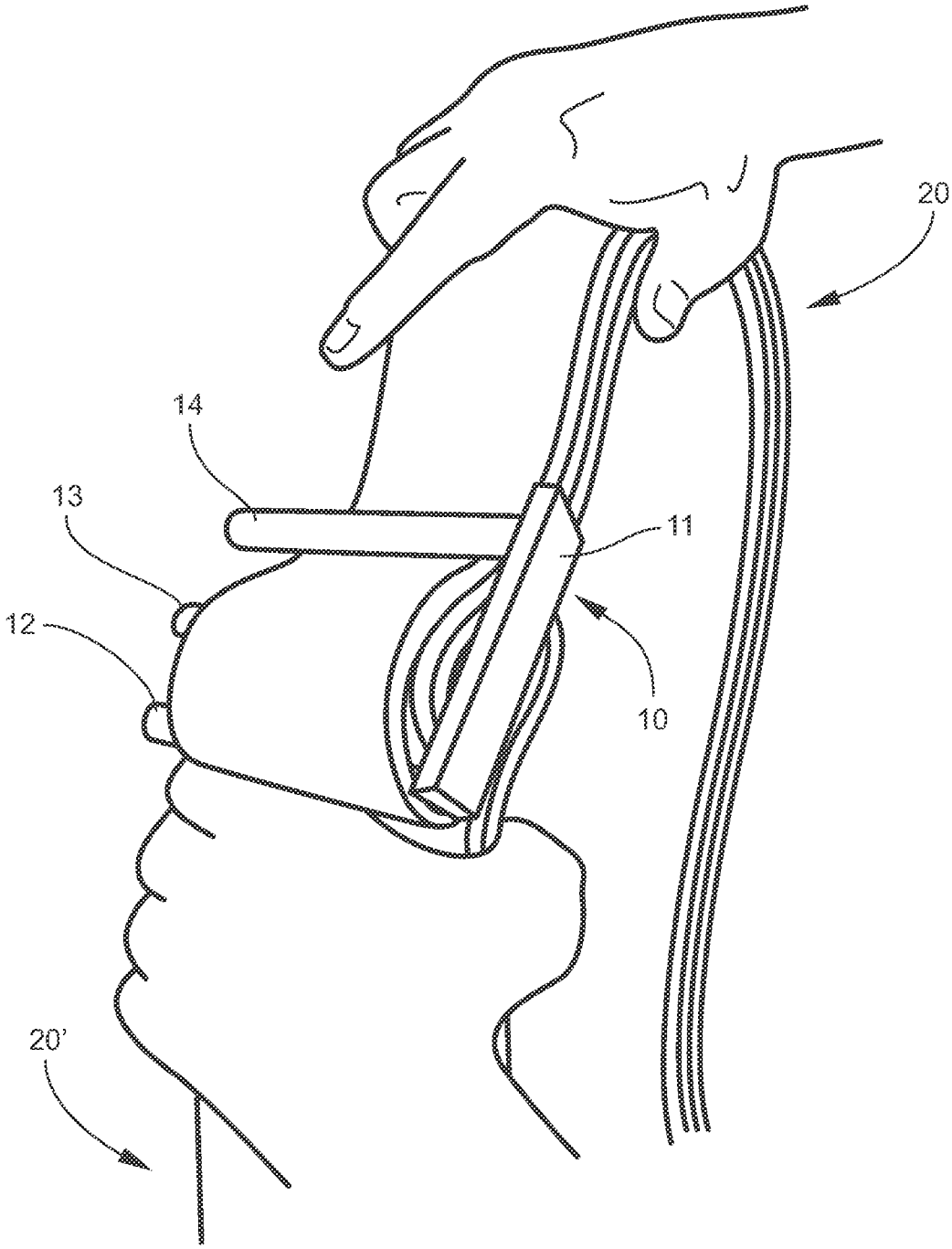
Figure 15:
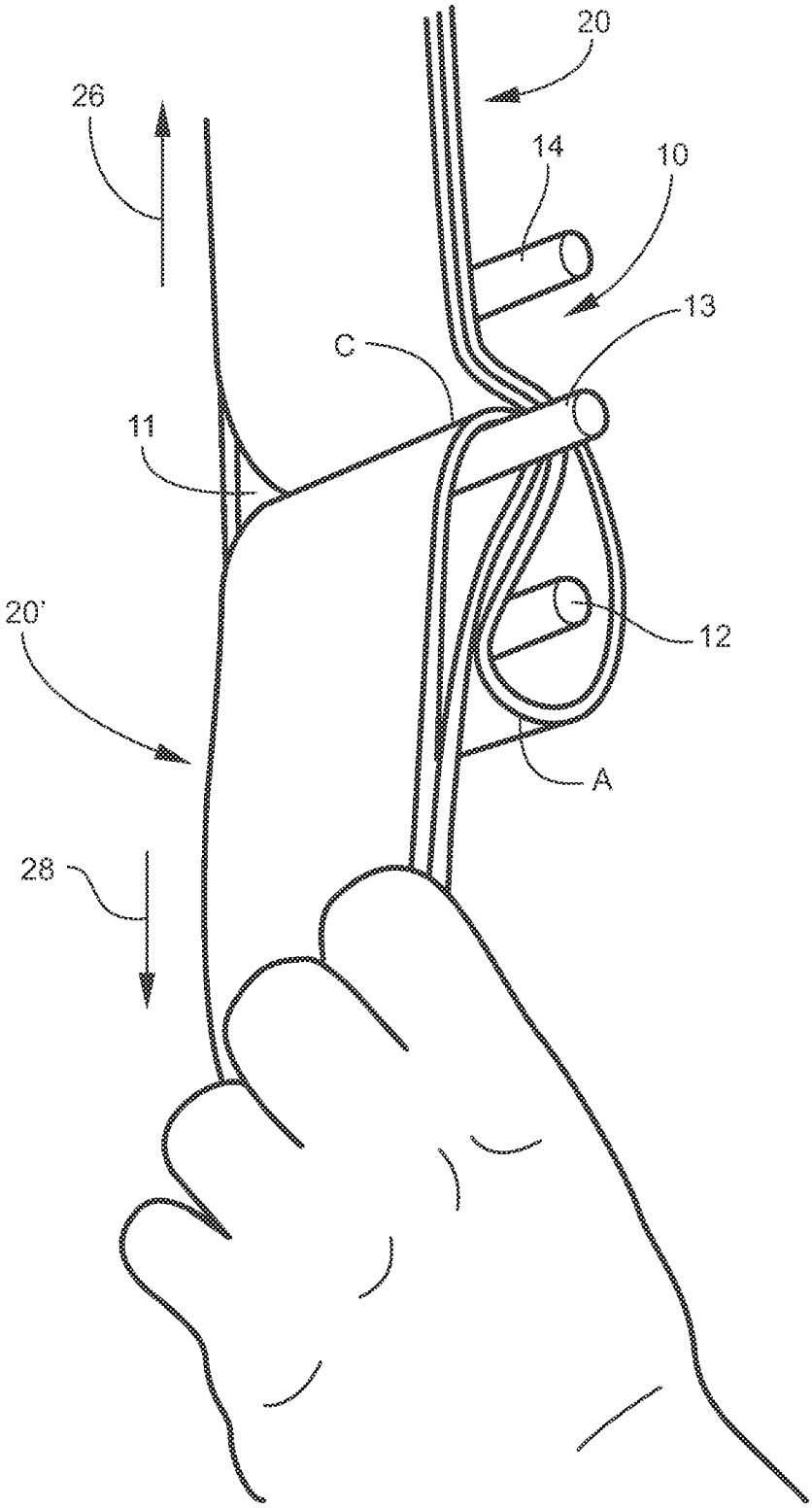
Figure 16:
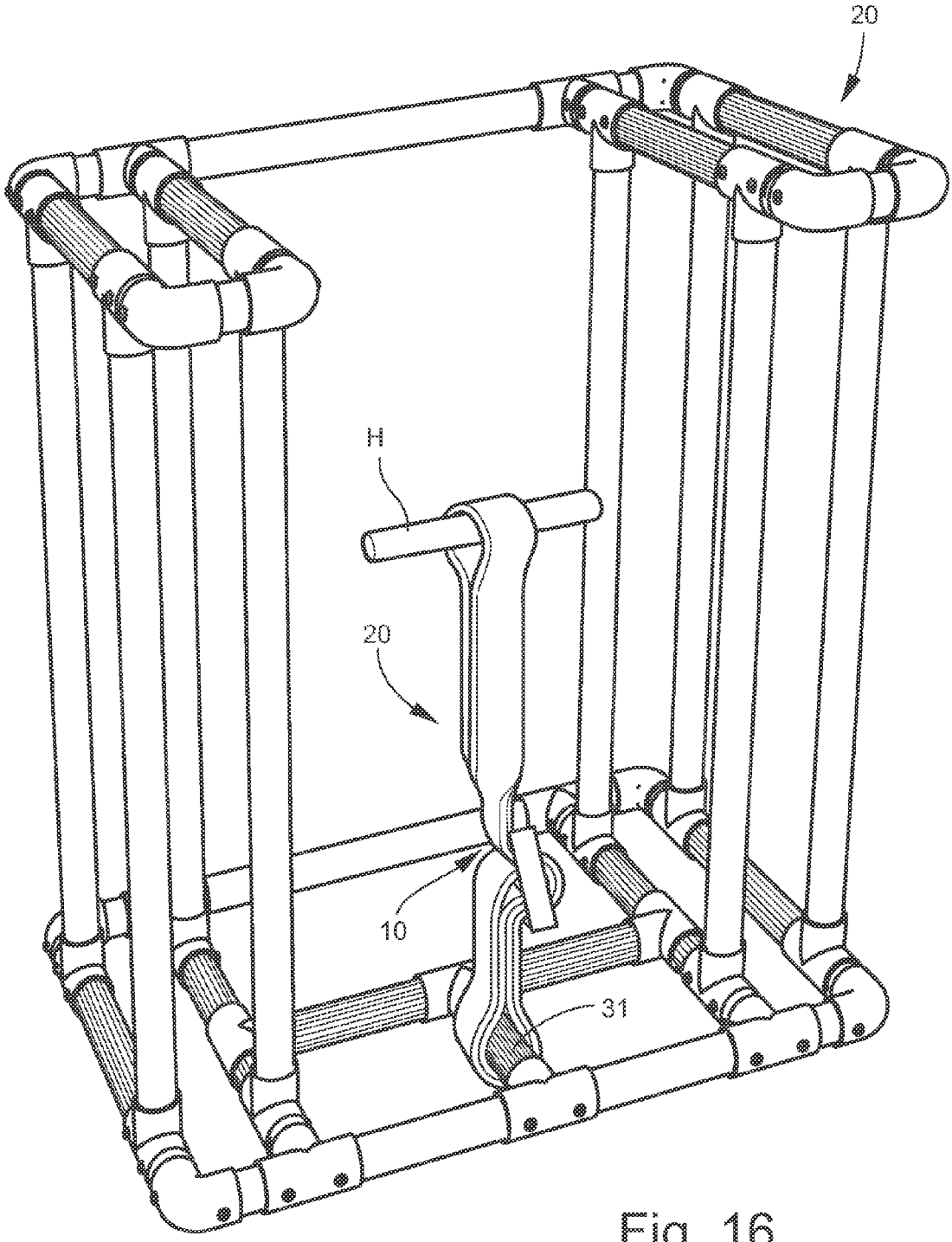
FIGS. 16-20 are sequential views demonstrating application of the exemplary band connector for securing a single exercise resistance band to a stationary exercise stand.

FIGS. 10-15 demonstrate use of the exemplary band connector 10 for interconnecting respective ends ("A" and "C") of two elastic exercise resistance bands 20, 20'. The user grasps both looped ends "A" and "C", one in each hand as shown in FIG. 10, brings the two bands 20, 20' together and then folds one end "A" over the other "C" as shown in FIG. 11. While holding the folded end "A" in place with one hand, the user grasps the band connector 10 at its base 11 with the other hand (See FIG. 12), and then inserts the rigid prongs 12 and 13 of the connector 10 through respective looped ends "A" and "C" of the two bands 20, 20', as demonstrated in FIGS. 12 and 13. The third prong 14 resides to the outside of the two bands 20, 20'. Once the band connector 10 is fully and properly inserted, as shown in FIGS. 14 and 15, the user grasps and pulls both bands 20, 20' outwardly in opposite directions away from the connector 10 (as indicated by arrows 26 and 28 in FIG. 15) in order to tension and frictionally lock the connection.

Figure 17:
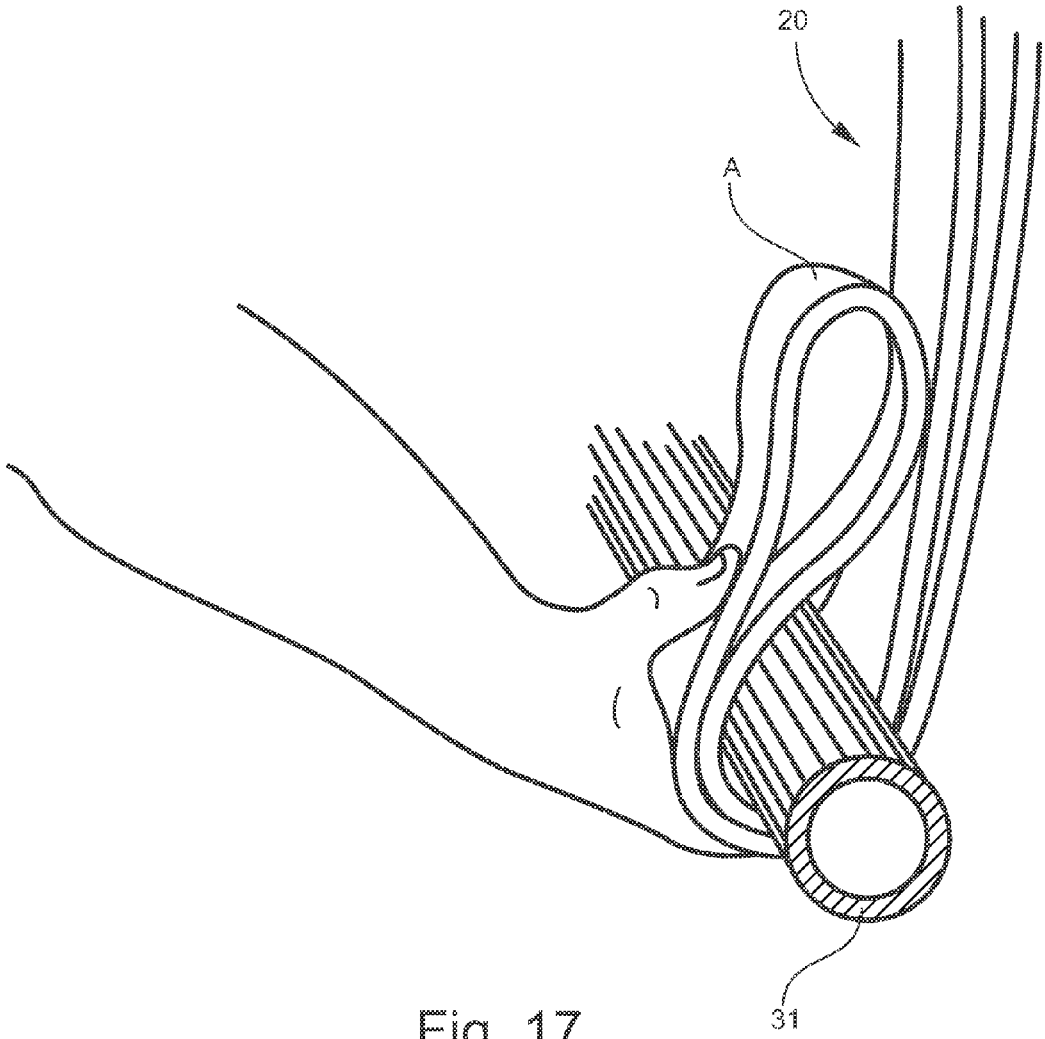
Figure 18:
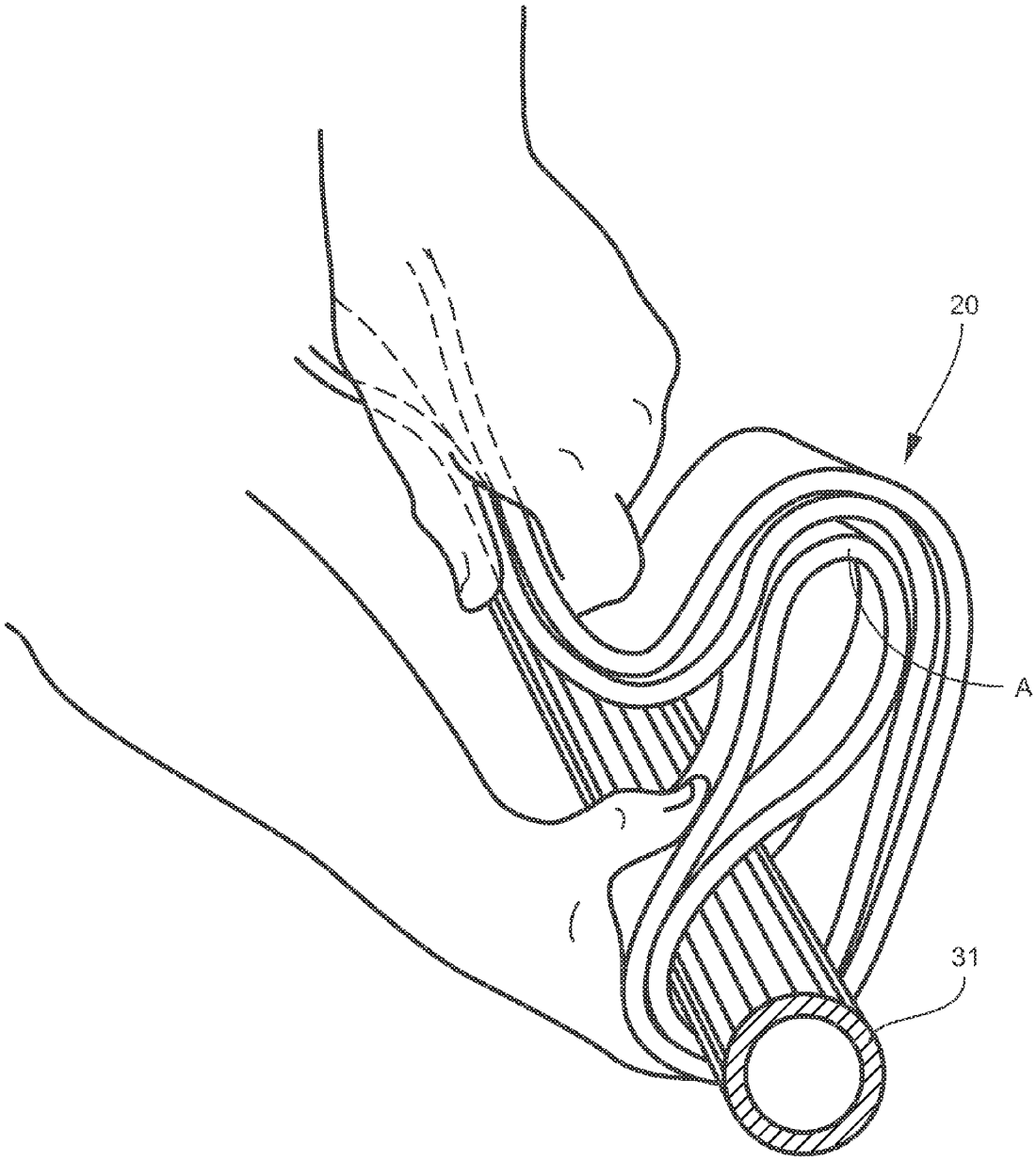
Figure 19:
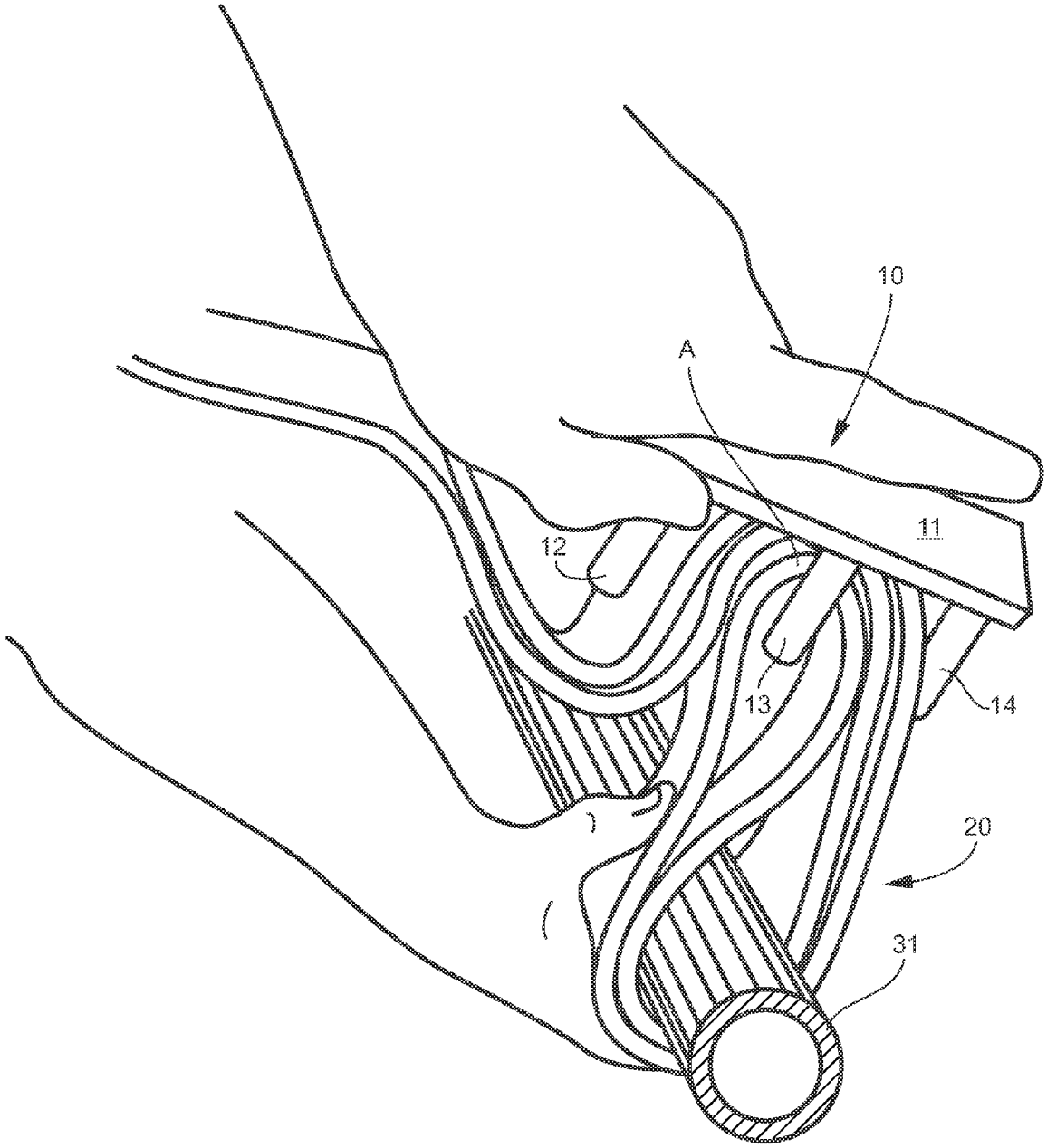
Figure 20:
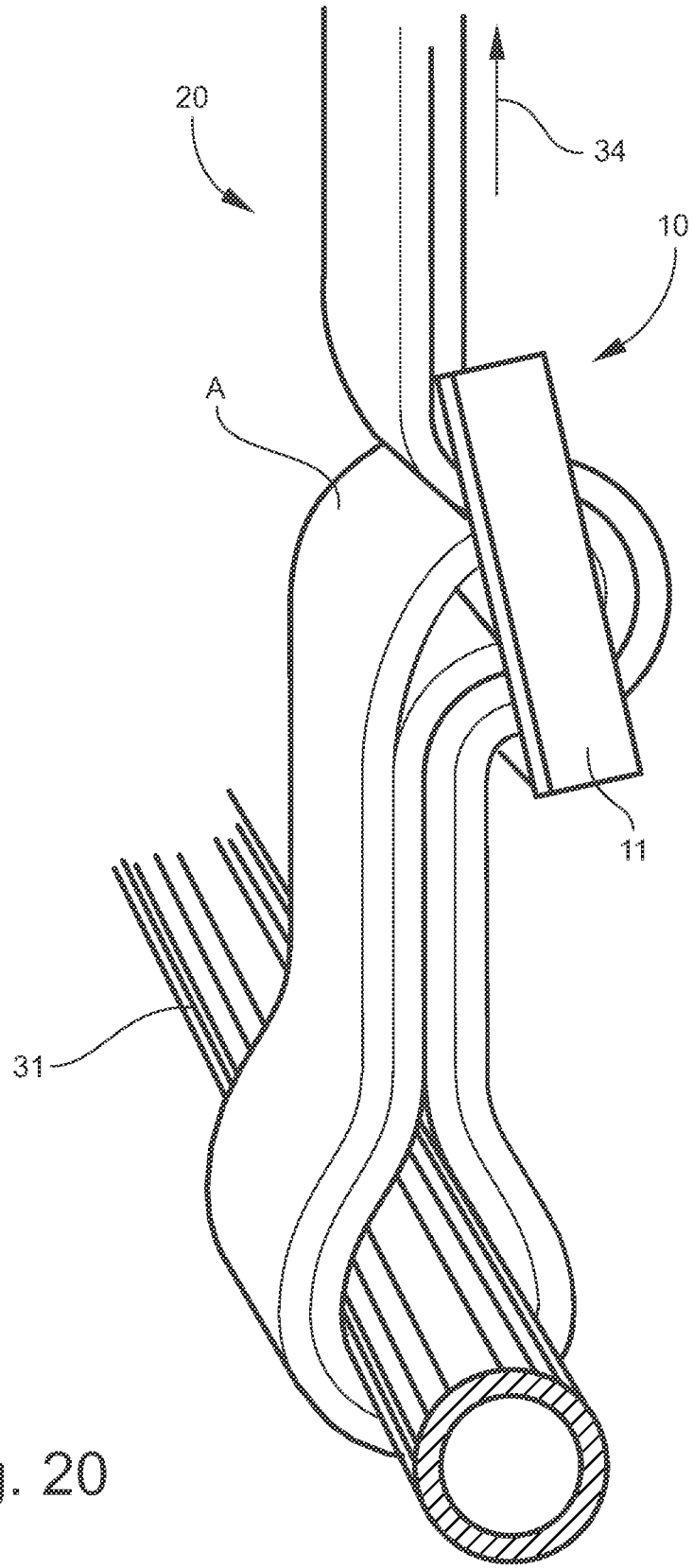

A further exemplary use of the present band connector 10 is demonstrated in FIGS. 16-20. In this implementation, the band connector 10 functions to secure a single elastic exercise resistance band 20 to a stationary exercise stand 30. The opposite end of the resistance band 20 may be secured to a movable handle "H" loosely inserted through the opposite looped end. As shown in FIG. 17, one looped end "A" of the exercise band 20 is passed under and around a selected bar 31 of the exercise stand 30. The exercise band 20 is then folded over the looped end "A", as shown in FIG. 18. Holding the band 20 in position with one hand, the user then grasps the band connector 10 at its base 11 with the other hand and inserts the center prong 13 through the looped end "A", as shown in FIG. 19. The two outer prongs 12 and 14 of the band connector 10 reside outside of the exercise band 20. Once the band connector 10 is fully and properly inserted, the user grasps the exercise band 20 and pulls outwardly in the direction indicated at arrow 34 to tension and frictionally lock the connection.

Figure 21:
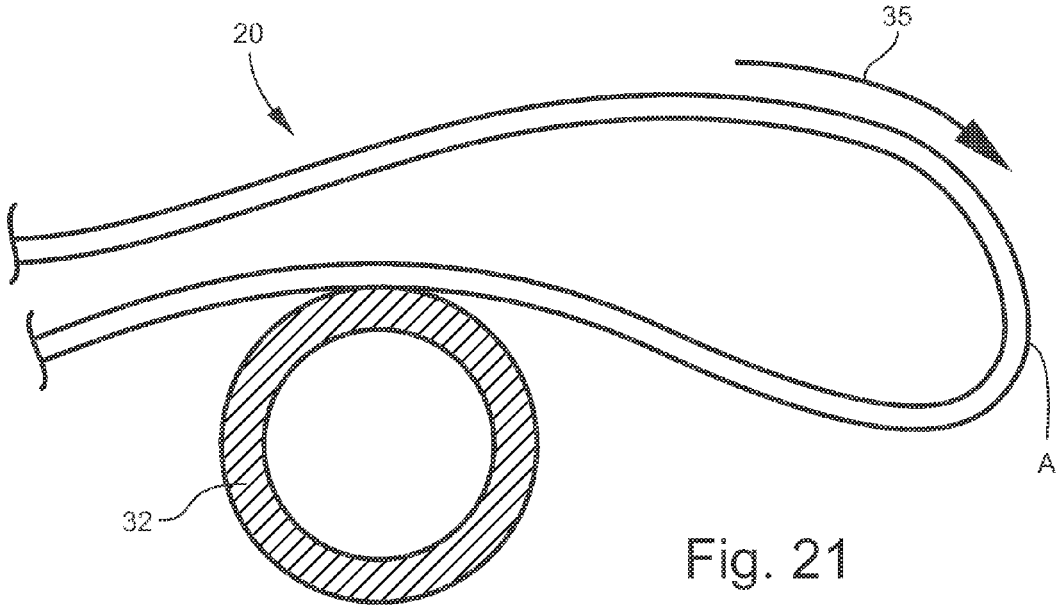
FIGS. 21-24 are further sequential views demonstrating an alternative application of the exemplary band connector for securing a single exercise resistance band to an adjacent structure.
Figure 22:
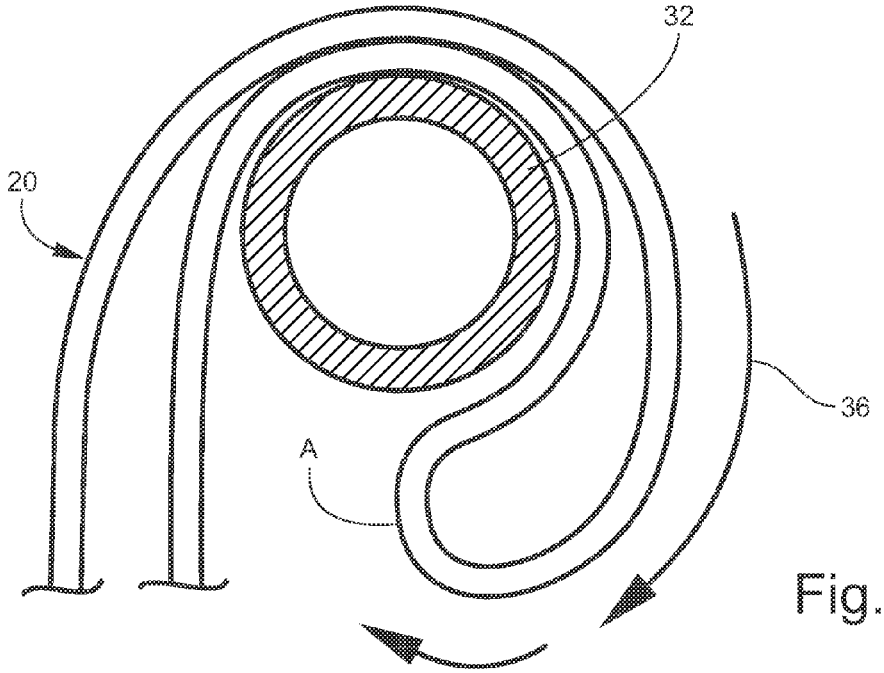
Figure 23:
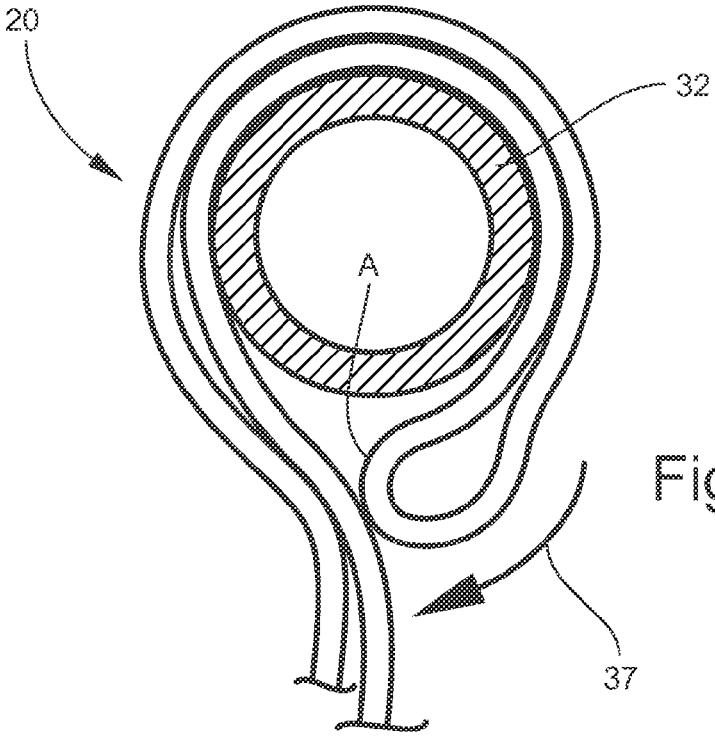
Figure 24:
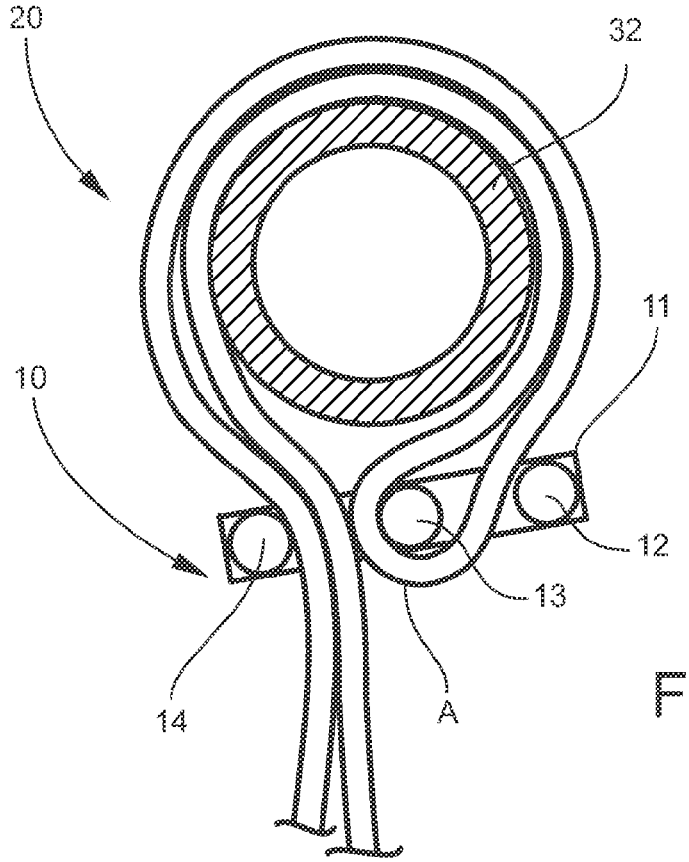

FIGS. 21-24 demonstrate further use of the exemplary band connector 10 to secure a single elastic exercise resistance band 20 to a fixed or movable bar 32. As shown in FIGS. 21, 22, and 23 and indicated by arrows 35, 36, and 37, one looped end "A" of the exercise band 20 is passed around and under the bar 32. Holding the resistance band 20 in position with one hand, the user then grasps the band connector 10 with the other hand and inserts the center prong 13 through the looped end "A", as shown in FIG. 24. The two outer prongs 12 and 14 of the band connector 10 reside outside of the exercise band 20. Once the band connector 10 is fully and properly inserted, the user grasps the exercise band 20 and pulls outwardly to tension and frictionally lock the connection.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed

1. A method for securing an elastic resistance exercise band to an adjacent structure prior to performing an exercise, the exercise band being formed in a closed loop and longitudinally folded to define opposing first and second free ends and an intermediate length between the free ends, said method comprising:

extending the first free end of the exercise band around the adjacent structure;

holding the first free end of the exercise band proximate a portion of the intermediate length, such that the exercise band substantially encircles the adjacent structure;

folding the portion of intermediate length over the first free end of the exercise band;

using a pronged band connector comprising a rigid center prong and first and second outer prongs:

i. inserting the center prong through an opening defined by the first free end of the exercise band; and ii. locating the folded portion of intermediate length between the center prong and respective first and second outer prongs; and tensioning the exercise band at the pronged band connector; and securing the second free end of the exercise band to an elongated rigid exercise bar.

2. A method according to claim 1, wherein the center and outer prongs of the band connector extend substantially perpendicular to a base of the connector.

3. A method according to claim 1, wherein a length of each prong is greater than a width of the exercise band.

4. A method according to claim 1, wherein a distance between adjacent prongs of the band connector is between approximately 0.5 and 1.0 inches.

5. A method according to claim 1, wherein the length of each prong is between approximately 2 and 5 inches.

6. A method according to claim 1, wherein a width of the exercise band is between approximately 0.5 and 5 inches.

7. A method according to claim 1, wherein a thickness of the exercise band is between approximately 0.125 and 0.500 inches.

8. A method according to claim 1, wherein the exercise band comprises graduated markings.

9. A method according to claim 8, and comprising locating the pronged band connector at a selected marking on the exercise band.

10. A method according to claim 1, wherein the center and outer prongs of the band connector are substantial identical in length and diameter.

11. A method according to claim 1, wherein the center and outer prongs of the band connector have respective beveled tips.

12. A method for securing a first elastic resistance exercise band to an adjacent second elastic resistance exercise band prior to performing an exercise, each of the first and second exercise bands being formed in a closed loop and longitudinally folded to define opposing first and second free ends and an intermediate length between the free ends, said method comprising:

folding the first free end of the first exercise band over the first free end of the second exercise band;

using a pronged band connector comprising a rigid center prong and first and second outer prongs:

i. inserting the center prong through an opening defined by the first free end of the second exercise band;

ii. inserting the first outer prong through an opening defined by the first free end of the first exercise band; and iii. locating the second outer prong adjacent an outside of the first exercise band, such that the first exercise band extends between the center prong and the second outer prong; and tensioning the first and second exercise bands at the pronged band connector; and securing the second free end of one of the first and second exercise bands to an elongated rigid exercise bar.

13. A method according to claim 12, wherein the center and outer prongs of the band connector extend substantially perpendicular to a base of the connector.

14. A method according to claim 12, wherein a length of each prong is greater than a width of each exercise band.

15. A method according to claim 12, wherein a distance between adjacent prongs of the band connector is between approximately 0.5 and 1.0 inches.

16. A method according to claim 12, wherein the length of each prong is between approximately 2 and 5 inches.

17. A method according to claim 12, wherein a width of each exercise band is between approximately 0.5 and 5 inches.

18. A method according to claim 12, wherein a thickness of each exercise band is between approximately 0.125 and 0.500 inches.

19. A method according to claim 12, wherein at least one of the first and second exercise bands comprises graduated markings.

20. A method according to claim 19, and comprising locating the pronged band connector at a selected marking on the exercise band.

* * * * *